US005591059A

United States Patent [19]

Lehman

[11] Patent Number: 5,591,059

[45] Date of Patent: Jan. 7, 1997

[54] WATER SKI

[75] Inventor: Peter Lehman, Evanston, Ill.

[73] Assignee: SP Water Sports, Inc., Evanston, Ill.

[21] Appl. No.: 399,491

[22] Filed: Mar. 7, 1995

[51] Int. Cl.[6] ..... B63B 35/81

[52] U.S. Cl. ..... 441/68; 441/70; 441/79

[58] Field of Search ..... 441/65, 68, 70, 441/72, 73, 74, 79; D21/228, 229

[56] References Cited

U.S. PATENT DOCUMENTS

| | | | |
|---|---|---|---|
| D. 342,114 | 12/1993 | Healy | D21/228 |
| 3,042,945 | 7/1962 | Saeman | D21/228 |
| 3,056,148 | 10/1962 | Abbott et al. | 441/70 |
| 3,082,443 | 3/1963 | Kimura | 441/65 |
| 3,119,130 | 1/1964 | Senne et al. | 441/70 |
| 3,571,832 | 3/1971 | Rauch . | |
| 3,950,807 | 4/1976 | Sharpe | 441/79 |
| 4,206,933 | 6/1980 | Koch | 280/18 |
| 4,305,603 | 12/1981 | Muller et al. | 441/65 |

*Primary Examiner*—Sherman Basinger
*Attorney, Agent, or Firm*—Arent Fox Kintner Plotkin & Kahn

[57] ABSTRACT

A water ski having an elongated body of generally uniform thickness from its nose to its aft end, and including a body having a nose portion which inclines gradually upwardly, a forward body portion, and a rear body portion. The forward body portion has a width which is generally uniform and which is like that of a conventional water ski. The rear body portion extends rearwardly from the forward body portion and has side edges which diverge outwardly and rearwardly toward the rear end of the ski, with the width of the ski at its rear end being at least 150% of the width of the forward body portion. The longitudinal length of the rear body portion is from 25 to 75% of the length of the ski.

33 Claims, 2 Drawing Sheets

WATER SKI

BACKGROUND OF THE INVENTION

The present invention relates to a modified water ski which facilitates its usage and which provides an improved and more stable ride.

Conventional water skis are typically elongated members which have a forwardly extending prow or nose and a flat body of a generally uniform thickness and width. The nose curves upwardly and forwardly and tapers gradually to a dull point. The bottom is usually flat and smooth and sometimes is provided with a thin shallow rudder or fin near the aft end. The bottom can be concave or tunneled as well. Such skis may have bindings for one or two feet, and the stirrups may comprise heel and toe pieces or toe pieces only.

The purpose of conventional water skis as just described is to provide for planing on the surface of water and to facilitate conventional maneuvers such as gliding or jumping over waves, wakes and the like in as smooth and speedy a fashion as possible. Water skis of this type are intended also to facilitate getting the skis up onto a planing condition, to provide the greatest degree of control, and to provide minimum resistance to passage of the ski through the water. It would be desirable to provide a water ski which is easier for beginners to use, and one which provides greater stability and a smoother ride.

SUMMARY OF THE INVENTION

In accordance with the present invention, an improved water ski is provided. The water ski has an elongated body of generally uniform thickness from its nose to its aft end, the body having a nose portion which inclines gradually upwardly, a forward body portion, and a rear body portion, the forward body portion having a width which is generally uniform and which is like that of a conventional water ski, the rear body portion extending rearwardly from the forward body portion and having side edges which diverge outwardly and rearwardly toward the rear end of the ski, the width of the ski at its rear end being at least 150% of the width of the forward body portion, and wherein the longitudinal length of the rear body portion is from 25 to 80% of the length of the ski. The side edges may be straight side edges and the aft end may be straight across. In another form the side edges may be curved side edges.

Preferably the rear body portion is generally trapezoidal in configuration. The aft end may be V-shaped in configuration. Bindings are desirably provided, with the longitudinal center of the bindings being at about the longitudinal center or to the rear of the longitudinal center of the ski. The ski may mount rudder elements adjacent the aft end. The longitudinal length of the rear body portion is preferably from about 25% to about 75% of the longitudinal length of the ski, the width of the rear body portion at its widest point being at least 150% of the width of the front body portion at its widest point. In one preferred form, the ski body is flat.

Further objects, features and advantages of the present invention will become apparent from the following description and drawings.

DETAILED DESCRIPTION

Figure 1:
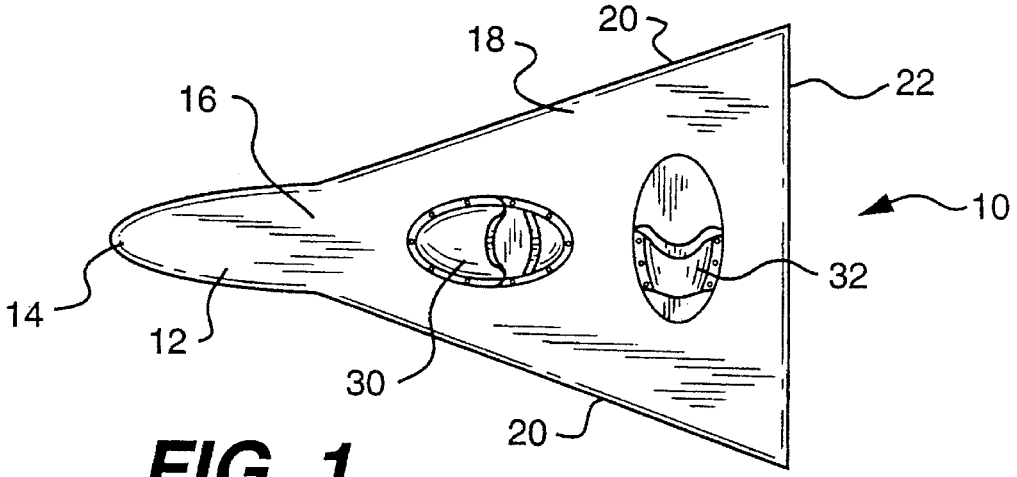
FIG. 1 is a top plan view of a water ski made in accordance with the present invention.
Figure 2:
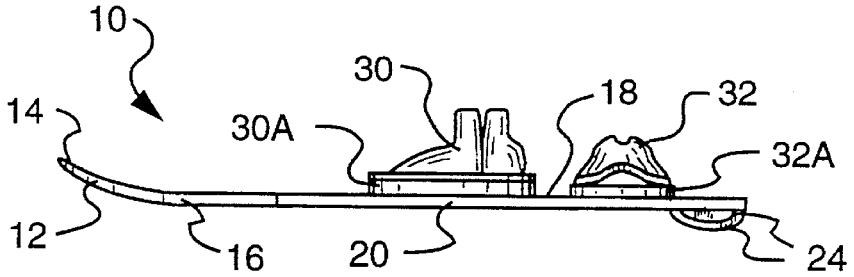
FIG. 2 is a side elevational view of the water ski of FIG. 1.
Figure 3:
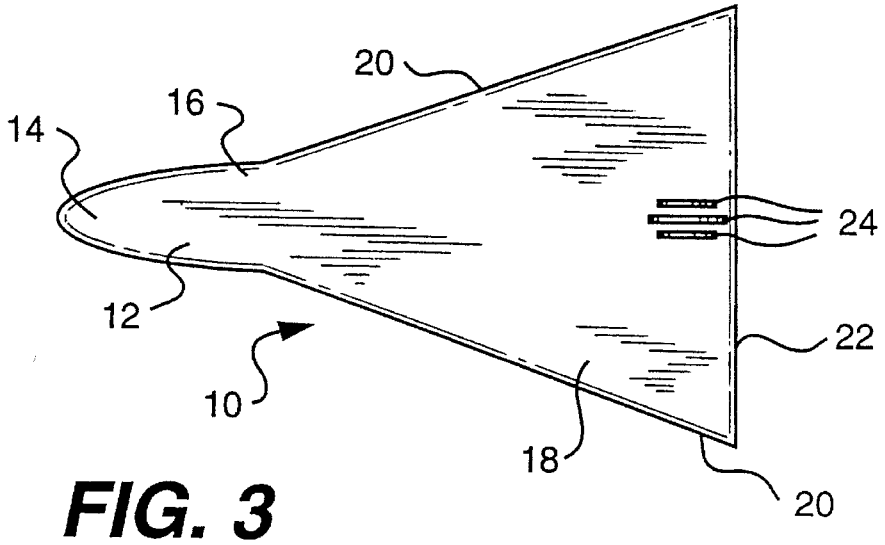
FIG. 3 is a bottom plan view of the water ski of FIG. 1.

Referring first to FIGS. 1 to 3, a water ski 10 made in accordance with the present invention is elongated and comprises an elongated narrow body portion terminating at its forward end in an upwardly and forwardly extending nose or prow and which extends rearwardly in a body portion of increasing width. Thus ski 10 includes a nose 12 which tapers to a dull point 14, a narrow forward body portion 16 of generally uniform width in plan view, and a rearwardly extending rear body portion 18 of increasing and increased width. In the embodiment of FIG. 1 the bottom of the ski is generally flat throughout its length.

In the embodiment of FIG. 1, the rear body portion 18 is generally trapezoidal in shape and has two side edges 20 which diverge outwardly (in a rearward direction) at an angle of about 20 degrees toward the straight across rear end 22 of the water ski. This angle may range from about 15 to about 40 degrees depending upon the relative lengths of the nose and forward body portion to that of the rear body portion. In the embodiment of FIG. 1 the nose and forward body portion are about 30% of the total length of the ski. The width of the rear body portion at the aft end is about 400% of the front body portion.

The ski 10 also mounts a rudder at its rear. Preferably the rudder comprises multiple members such as spread-out triple elements 24 which are relatively shallow, but which help provide stability and minimize side-slip of the ski in use. The middle element may be longer, preferably 2 to 6 inches.

In addition, the ski 10 is provided with bindings which, for the front foot may comprise a conventional heel and toe binding 30, and for the rear foot may comprise a conventional toe binding 32. Other known bindings may be used instead. Further, as illustrated by other of the figures, the bindings may be oriented forwardly or sidewardly. Finally, the bindings may be attached via adjustable plates 30A, 32A to adjust the longitudinal locations of the bindings. Typically the bindings are located such that the center point of the two bindings is rearward of the longitudinal center of the ski, although they may be centered in the central portion as well.

The ski 10 may have a narrow, forward body portion width of about 7 inches and may have an overall length of about 40 to 50 inches. The thickness of the ski may be about ¾ to 1 inch. It may be molded of plastic (except for the added bindings) and the rudders may be integrally formed during molding. Alternatively the rudder elements may be of metal and may be added later. The ski should preferably be buoyant and therefore the material of which it is made should be lighter than water or may have a foam or cellular interior. The exterior of the ski may be provided with a skin or coating which tends to reduce drag and therefore to promote movement of the ski relative to the water it traverses. The materials of manufacture may be selected for strength, buoyancy and weight.

It will be appreciated that the rear body portion may be viewed as a continuation of the narrow forward body portion and as a pair of triangular wings which diverge outwardly. It is the addition of these wings and the overall resulting shape for the rear body portion that provides the greatly improved riding characteristics.

In particular, the ski of FIGS. 1–3 provides a smoother ride. Because of that and the improved stability, it is easier to learn on and easier to learn various maneuvers on. It is easier to stand on than a conventional water ski, is easier to balance on and is more stable when jumping and crossing wakes. These are significant and important for beginners and recreational users of water skis, and expand greatly the candidates who might participate in the sport. The principles of the invention can be applied to skis to be used by advanced water skiers as well.

Figure 4:
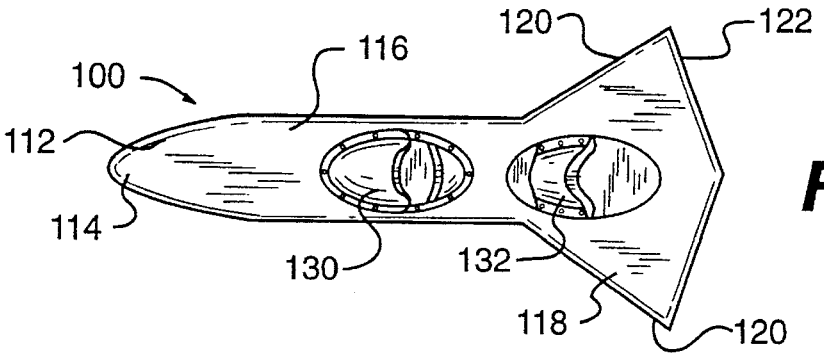
FIG. 4 is a plan view of a further water ski made in accordance with the present invention.

FIG. 4 illustrates another ski configuration of the present invention. In this embodiment ski 100 inclines a tapered nose section 112 which inclines upwardly to a dull point 114. A narrow forward body portion 116 of generally uniform width extends rearwardly to a rear body portion 118. The rear body portion has two side edges 120 which flare or diverge outwardly at an angle of about 35 degrees. The width of its rear body portion at the aft end is about 300% of the width of the forward body portion 116. Body portion 118 terminates in a shallow V-shaped rear end 122. Again triple elements (not shown) like those of FIG. 3 are present on the bottom of the rear body portion 118, suitable bindings 130, 132 for the front and rear feet are provided, and the bottom of the ski is generally flat in this embodiment. The nose and forward body portion are approximately 65% of the length of the skis.

Figure 5:
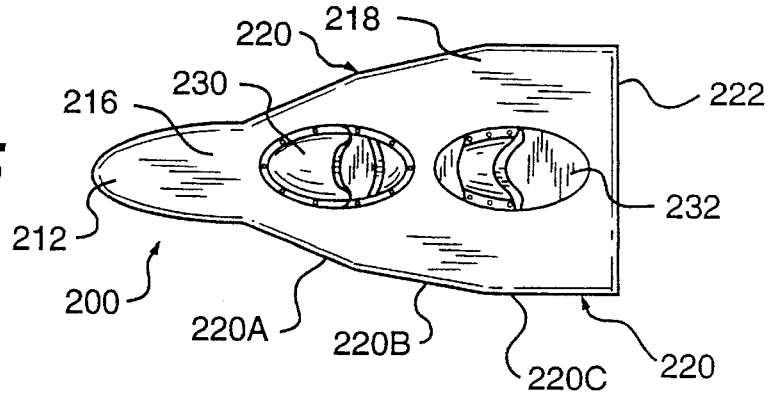
FIG. 5 is a top plan view of another water ski made in accordance with the present invention.

Another configuration of a water ski in accordance with this invention is shown in FIG. 5. Ski 200 includes tapered nose section 212 which turns up as shown in FIG. 2, a narrow forward body portion 216 and a rear body portion 218. Body portion 218 terminates in rear end 222. The rearwardly diverging side edges 220 of the rear body portion 218 are made up of a plurality of tapering side segments 220A and 220B and rearwardly extending segments 220C defining wing-like extensions beyond the forward body portion 216. Plural rudder elements structured and positioned as shown in FIGS. 2 and 3 are present as well. Suitable bindings 230, 232, like those described in connection with the other embodiments, are present as well. Again, the bottom of ski 200 may be generally flat. The width of the rear body portion of the aft end is about 250% of the width of the forward body portion. The forward end of the ski is about 28 percent of the overall length thereof.

Figure 6:
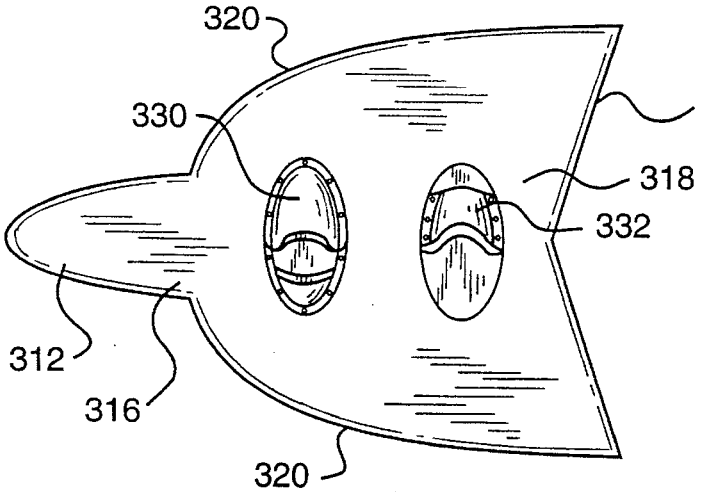
FIG. 6 is a top plan view of yet another water ski made in accordance with the present invention.

The water ski 300 of FIG. 6 also has a tapered nose section 312, a forward body portion 316 and a rear body portion 318 terminating in a V-shaped rear end 322. The bottom may be flat. The side edges 320 diverge and curve rearwardly to provide wing-like extensions trailing the forward body portion 316. Bindings 330, 332 are provided as are rudder elements like those shown in FIGS. 2 and 3. The length of the nose and forward body portion is about 30% of the length of the entire ski. The width of the rear body portion at the aft end is about 360% of the width of the forward body portion.

Figure 7:
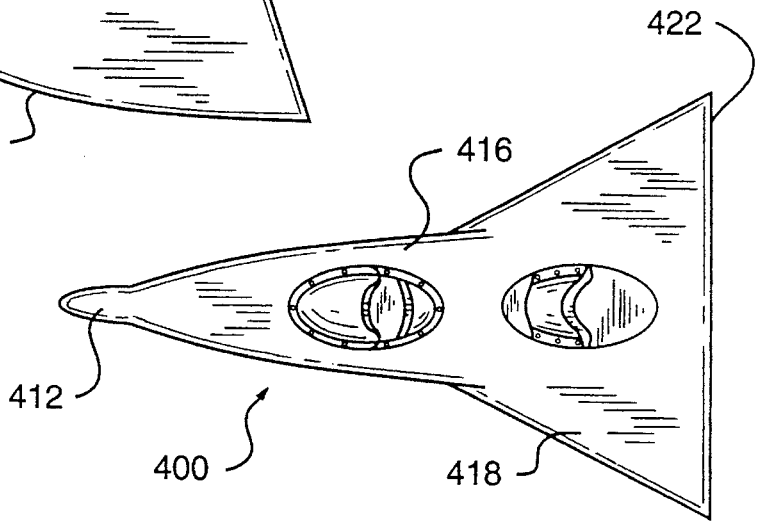
FIG. 7 is a top plan view of a still further water ski made in accordance with the present water ski.

The water ski 400 of FIG. 7 includes a nose section 412, a forward body portion 416 and a rear body portion 418 terminating in a straight across trailing end 422. The rear body portion 418 flares outwardly towards the rear. Bindings and rudder elements like those shown in FIG. 1–3 are also provided. In the water ski 400, the front body portion widens somewhat more over its length than in other of the embodiments, such as that of FIG. 4. Its characteristics and behavior are, however, somewhat similar. The length of the nose and forward section is about 60% of the length of the water ski.

In a preferred form, the water skis of the present invention have rear body portions which are from about 25 to about 80 percent of the lengths of the water skis, and most preferably from about 25 to about 75 percent of the overall lengths of the water skis. The width of the skis at the rear ends (their widest points) are at least 150% of the width of the forward body portion and preferably from about 175% to about 400 percent of the width of the forward body portion at its widest point.

From the foregoing it will be apparent to those skilled in the art that further modifications may be made and provided without departing from the spirit of the invention. Accordingly, the scope of the invention is to be considered as limited only to the extent made necessary by the appended claims.

What is claimed is:

1. A water ski having an upper surface and a lower surface and an elongated body of generally uniform thickness from its nose to its aft end, said body having a nose portion which inclines gradually upwardly in a forwardly direction, a forward body portion, and a rear body portion, and said forward body portion having a width which is generally uniform, said rear body portion extending rearwardly from the forward body portion and having side edges which diverge outwardly and rearwardly toward the aft end of the ski, the width of the ski at its aft end being at least 150% of the width of said forward body portion, the longitudinal length of said rear body portion being from 25 to 75% of the longitudinal length of the ski, wherein the ski has three generally parallel, spaced-apart rudder elements mounted on said lower surface adjacent the aft end, the three rudder elements being shallow in depth, the middle one of said three rudder elements being longer than the other two of said three rudder elements, and bindings on said upper surface, the longitudinal center of said bindings being to the rear of the longitudinal center of the ski.

2. A water ski in accordance with claim 1, and wherein said side edges are straight side edges.

3. A water ski in accordance with claim 1, and wherein said aft end is straight across.

4. A water ski in accordance with claim 1, and wherein said side edges are curved side edges.

5. A water ski in accordance with claim 1, and wherein said rear body portion is generally trapezoidal in configuration.

6. A water ski in accordance with claim 1, and wherein said aft end is V-shaped in configuration.

7. A water ski in accordance with claim 1, and wherein the width of the rear body portion at its widest point is at least 150% of the width of the front body portion at its widest point.

8. A water ski in accordance with claim 7, and wherein the ski forward body portion and rear body portion are generally flat and substantially coplanar.

9. A water ski in accordance with claim 1, and wherein the ski forward body portion and rear body portion are generally flat and substantially coplanar.

10. A water ski in accordance with claim 1 wherein said bindings are attached to said ski via adjustable plates, said adjustable plates allowing the positions of said bindings on said ski to be adjusted.

11. A water ski in accordance with claim 1 wherein said ski is comprised of buoyant material having a foam interior.

12. A water ski in accordance with claim 1 wherein said rudder elements are comprised of metal.

13. A water ski in accordance with claim 1 wherein said rudder elements are integrally formed with and comprised of the same material as said ski.

14. A water ski having an upper surface and a lower surface and an elongated body of generally uniform thickness from its nose to its aft end, said body having a nose portion which inclines gradually upwardly in a forwardly direction, a forward body portion, and a rear body portion wherein:

said forward body portion has a width which is generally uniform;

said rear body portion extends rearwardly from the forward body portion and has side edges which diverge outwardly at an angle of 35 degrees and rearwardly toward the aft end of the ski, the width of the rear body portion at the aft end being at least 300% of the width of the forward body portion, said rear body portion terminating in a V-shaped aft end, the longitudinal length of said rear body portion being at least 35% of the longitudinal length of the ski;

wherein the ski has three generally parallel, spaced-apart rudder elements mounted on said lower surface adjacent the aft, the three rudder elements being shallow in depth, the middle one of said three rudder elements being longer than the other two of said three rudder elements, and said ski having bindings on said upper surface, the longitudinal center of said bindings being to the rear of the longitudinal center of the ski.

15. A water ski in accordance with claim 14 wherein said bindings are attached to said ski via adjustable plates, said adjustable plates allowing the positions of said bindings on said ski to be adjusted.

16. A water ski in accordance with claim 14 wherein said ski is comprised of buoyant material having a foam interior.

17. A water ski in accordance with claim 14 wherein said rudder elements are comprised of metal.

18. A water ski in accordance with claim 14 wherein said rudder elements are integrally formed with and comprised of the same material as said ski.

19. A water ski having an upper surface and a lower surface and an elongated body of generally uniform thickness from its nose to its aft end, said body having a nose portion which inclines gradually upwardly in a forwardly direction, a forward body portion, and rear body portion wherein:

said forward body portion has a width which is generally uniform;

said rear body portion extends rearwardly from the forward body portion and has side edges which diverge outwardly and rearwardly, said side edges having a plurality of tapering side segments and rearwardly extending segments, said plurality of tapering side segments and rearwardly extending segments defining winglike extensions, the width of the rear body portion at the aft end being at least 250% of the width of the forward body portion, said rear body portion terminating in a straight across aft end;

the longitudinal length of said rear body portion being at least 72% of the longitudinal length of the ski, wherein the ski has three generally parallel, spaced-apart rudder elements mounted on said lower surface adjacent the aft end, the three rudder elements being shallow in depth, the middle one of said three rudder elements being longer than the other two of said three rudder elements, and said ski having bindings on said upper surface the longitudinal center of said bindings being to the rear of the longitudinal center of the ski.

20. A water ski in accordance with claim 19 wherein said bindings are attached to said ski via adjustable plates, said adjustable plates allowing the positions of said bindings on said ski to be adjusted.

21. A water ski in accordance with claim 19 wherein said ski is comprised of buoyant material having a foam interior.

22. A water ski in accordance with claim 19 wherein said rudder elements are comprised of metal.

23. A water ski in accordance with claim 19 wherein said rudder elements are integrally formed with and comprised of the same material as said ski.

24. A water ski having an upper surface and a lower surface and an elongated body of generally uniform thickness from its nose to its aft end, said body having a nose portion which inclines gradually upwardly in a forwardly direction, a forward body portion, and a rear body portion wherein:

said forward body portion has a width which is generally uniform;

said rear body portion extends rearwardly from the forward body portion and has side edges which diverge outwardly and curve rearwardly thereby providing winglike extensions, the width of the rear body portion at the aft end being at least 360% of the width of the forward body portion, said rear body portion terminating in an inverted V-shaped aft end, the longitudinal length of said rear body portion being at least 70% of the longitudinal length of the ski;

wherein the ski has three generally parallel, spaced-apart rudder elements mounted on said lower surface adjacent the aft end, the three rudder elements being shallow in depth, the middle one of said three rudder elements being longer than the other two of said three rudder elements, and said ski having bindings on said upper surface, the longitudinal center of said bindings being to the rear of the longitudinal center of the ski.

25. A water ski in accordance with claim 24 wherein said bindings are attached to said ski via adjustable plates, said adjustable plates allowing the positions of said bindings on said ski to be adjusted.

26. A water ski in accordance with claim 24 wherein said ski is comprised of buoyant material having a foam interior.

27. A water ski in accordance with claim 24 wherein said rudder elements are comprised of metal.

28. A water ski in accordance with claim 24 wherein said rudder elements are integrally formed with and comprised of the same material as said ski.

29. A water ski having an upper surface and a lower surface and an elongated body of generally uniform thickness from its nose to its aft end, said body having a nose portion which inclines gradually upwardly in a forwardly direction, a forward body portion, and a rear body portion wherein:

said forward body portion has a width which increases and extends outwardly;

said rear body portion extends rearwardly from the forward body portion and has side edges which diverge and flare outwardly and rearwardly toward the aft end of the ski, the width of the rear body portion of the aft end being at least 150% of the width forward body portion, said rear body portion terminating in a straight across aft end;

the longitudinal length of said rear body portion being at least 40% of the longitudinal length of the ski;

wherein the ski has three generally parallel, spaced-apart rudder elements mounted on said lower surface adjacent the aft end, the three rudder elements being shallow in depth, the middle one of said three rudder elements being longer than the other two of said three rudder elements, and said ski having bindings on said upper surface, the longitudinal center of said bindings being to the rear of the longitudinal center of the ski.

30. A water ski in accordance with claim 29 wherein said bindings are attached to said ski via adjustable plates, said adjustable plates allowing the positions of said bindings on said ski to be adjusted.

31. A water ski in accordance with claim 29 wherein said ski is comprised of buoyant material having a foam interior.

32. A water ski in accordance with claim 29 wherein said rudder elements are comprised of metal.

33. A water ski in accordance with claim 29 wherein said rudder elements are integrally formed with and comprised of the same material as said ski.

* * * * *